US007743443B2

(12) United States Patent
Wick et al.

(10) Patent No.: US 7,743,443 B2
(45) **Date of Patent: *Jun. 29, 2010**

(54) LIQUID APPLICATOR AND ABSORBENT SCRUBBING MEANS

(75) Inventors: Roberta A. Wick, Racine, WI (US); Jeanne A. O'Brien, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 293 days.

This patent is subject to a terminal disclaimer.

(21) Appl. No.: 11/767,251

(22) Filed: Jun. 22, 2007

(65) Prior Publication Data

US 2008/0041424 A1 Feb. 21, 2008

Related U.S. Application Data

(63) Continuation-in-part of application No. 11/564,376, filed on Nov. 29, 2006, now Pat. No. 7,596,974.

(60) Provisional application No. 60/805,159, filed on Jun. 19, 2006.

(51) Int. Cl.
*D06F 5/00* (2006.01)

(52) U.S. Cl. ..... 8/147; 401/118; 68/214

(58) Field of Classification Search ..... 68/214; 401/118–130; 8/147

See application file for complete search history.

(56) References Cited

U.S. PATENT DOCUMENTS 3,281,887 A * 11/1966 Raffe ..... 401/205
4,342,522 A * 8/1982 Mackles ..... 401/214
4,998,839 A 3/1991 Bashir
5,244,593 A 9/1993 Roselle et al.
5,776,206 A 7/1998 Kleber
5,840,675 A 11/1998 Yeazell
5,955,415 A 9/1999 Gutierrez et al.
5,993,097 A 11/1999 DeBaene
6,037,317 A 3/2000 Rapisarda et al.
6,048,368 A 4/2000 Tcheou et al.
6,074,705 A 6/2000 DeBaene (Continued)

FOREIGN PATENT DOCUMENTS

DE 350188388 9/1985

(Continued)

OTHER PUBLICATIONS

PCT/US2007/013897 International Search Report and Written Opinion dated May 27, 2008.

*Primary Examiner*—Frankie L Stinson

(57) ABSTRACT

A device for applying a functional formulation to a surface is disclosed. The device includes a reservoir with a valve assembly for dispensing an effective stain removal formulation directly to the stain, spot or mark. The device also includes a shell accommodating absorbent pads. In use, the functional formulation is delivered through the applicator tip to the surface. The applicator is then rotated and one of the absorbent pads is engaged with the formulation treated surface to dislodge soils and stains on the surface, distribute the functional formulation on the surface, absorb excess formulation from the surface, and/or to lessen visibility of the resulting moistened area as well as reduce the time needed for the moistened area to dry. Suitable functional formulations for use in association with the applicator are also disclosed.

19 Claims, 10 Drawing Sheets

U.S. PATENT DOCUMENTS

| | | | | |
|---|---|---|---|---|
| 6,376,444 | B1 | 4/2002 | Hortel et al. | |
| 6,514,924 | B1 | 2/2003 | Van Hauwermeiren et al. | |
| 6,644,879 | B2 | 11/2003 | Irvin et al. | |
| 6,689,730 | B2 | 2/2004 | Hortel et al. | |
| 6,689,736 | B2 | 2/2004 | Thomas et al. | |
| 6,692,173 | B2 | 2/2004 | Gueret | |
| 6,715,326 | B2 * | 4/2004 | Price | 68/213 |
| 6,811,338 | B1 | 11/2004 | Manske, Jr. et al. | |
| 6,829,913 | B2 * | 12/2004 | Goldoni et al. | 68/5 A |
| 6,832,867 | B2 | 12/2004 | Sandbach et al. | |
| 6,838,423 | B2 | 1/2005 | Irvin et al. | |
| 6,846,332 | B2 | 1/2005 | Boissie et al. | |
| 6,883,353 | B2 * | 4/2005 | Goldoni et al. | 68/5 A |
| 6,905,276 | B2 | 6/2005 | Van Buskirk et al. | |
| 6,939,839 | B2 | 9/2005 | Johnson | |
| 7,044,670 | B2 * | 5/2006 | Delage | 401/127 |
| 7,047,582 | B2 | 5/2006 | Moe et al. | |
| 7,125,189 | B2 | 10/2006 | Gueret | |
| 7,144,177 | B2 | 12/2006 | Van Buskirk et al. | |
| 2002/0091070 | A1 | 7/2002 | Engisch et al. | |
| 2003/0087781 | A1 | 5/2003 | Van Hauwermeiren et al. | |
| 2003/0145634 | A1 | 8/2003 | Price | |
| 2004/0005186 | A1 * | 1/2004 | Ueda et al. | 401/194 |
| 2004/0084063 | A1 | 5/2004 | Vago et al. | |
| 2004/0152616 | A1 | 8/2004 | Murphy et al. | |
| 2004/0231061 | A1 | 11/2004 | Irvin et al. | |
| 2005/0066996 | A1 | 3/2005 | France et al. | |
| 2005/0086761 | A1 | 4/2005 | Shenouda | |
| 2005/0119151 | A1 | 6/2005 | Mayer et al. | |
| 2005/0147455 | A1 | 7/2005 | Muhr-Sweeney | |
| 2005/0164903 | A1 | 7/2005 | Ko et al. | |
| 2005/0197268 | A1 | 9/2005 | Buskirk et al. | |
| 2005/0199265 | A1 | 9/2005 | France et al. | |
| 2005/0251944 | A1 | 11/2005 | Buskirk et al. | |
| 2006/0053567 | A1 | 3/2006 | Sandbach et al. | |
| 2006/0123562 | A1 | 6/2006 | Ghosh et al. | |
| 2006/0245816 | A1 | 11/2006 | Sharp et al. | |

FOREIGN PATENT DOCUMENTS

| | | | |
|---|---|---|---|
| DE | 19536714 | | 6/1999 |
| EP | 0 063 668 | | 3/1982 |
| EP | 0 218 371 | | 4/1987 |
| EP | 1 714 605 | | 10/2006 |
| EP | 1 714 712 | | 10/2006 |
| FR | 2561097 | | 9/1985 |
| GB | 971691 | A | 9/1964 |
| JP | 7100288 | | 4/1995 |
| JP | 2001149692 | | 6/2001 |
| WO | WO 97/20099 | | 6/1997 |
| WO | WO 99/02769 | | 1/1999 |
| WO | WO 99/04082 | | 1/1999 |
| WO | WO 99/46319 | | 9/1999 |
| WO | WO 01/04260 | | 1/2001 |
| WO | WO 01/04407 | | 1/2001 |
| WO | WO 02/079362 | | 10/2002 |
| WO | WO 02/079363 | | 10/2002 |
| WO | WO 02/079366 | | 10/2002 |
| WO | WO 02/079368 | | 10/2002 |
| WO | WO 02/079369 | | 10/2002 |
| WO | WO02/079370 | A3 | 10/2002 |
| WO | WO 02/479367 | | 10/2002 |
| WO | WO 2006/055713 | | 5/2006 |

* cited by examiner

FIG. 9
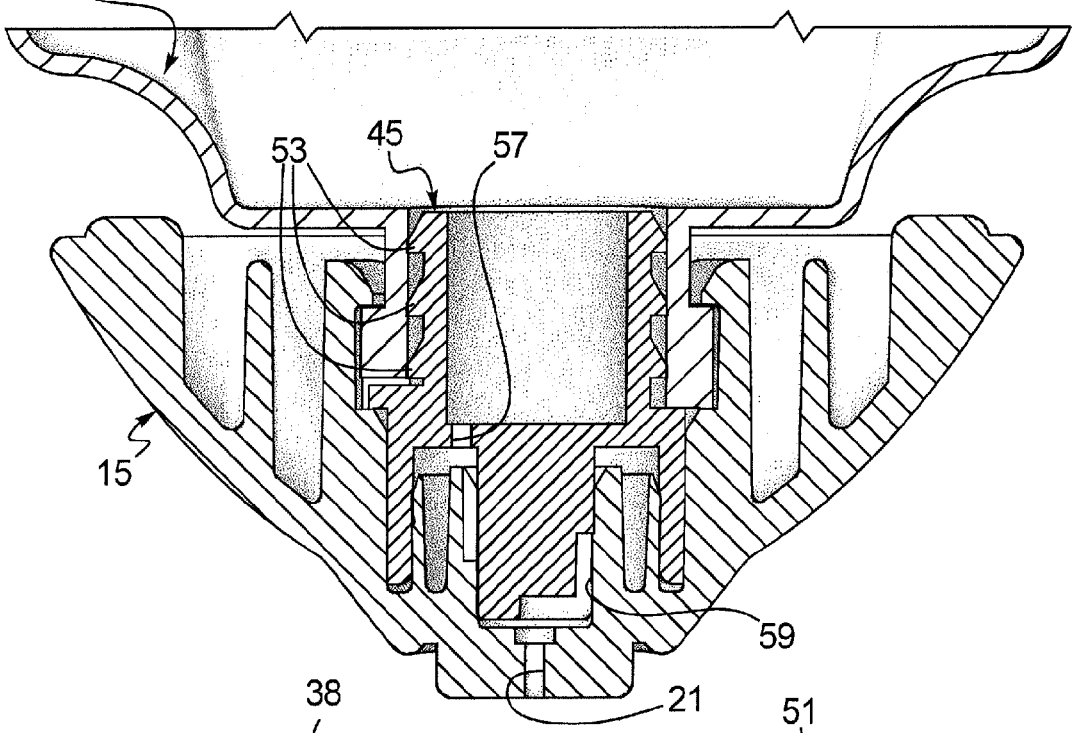
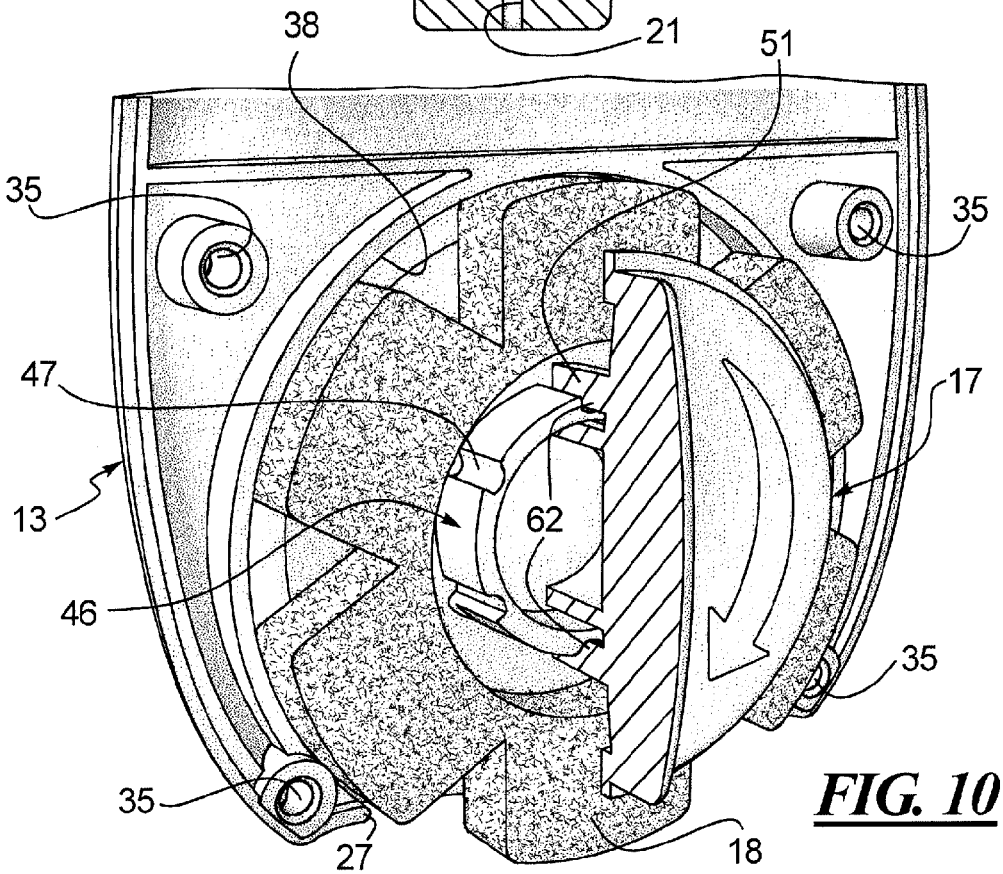
FIG. 10

LIQUID APPLICATOR AND ABSORBENT SCRUBBING MEANS

CROSS-REFERENCE TO RELATED APPLICATION

This application claims priority from U.S. patent application Ser. No. 11,564,376, filed on Nov. 29, 2006, which claims priority from provisional Application Ser. No. 60/805,159, filed on Jun. 19, 2006.

BACKGROUND

1. Technical Field

A device for applying a functional formulation on a garment is disclosed which comprises a compact structure provided with an applicator tip for dispensing the functional formulation. The device includes a reservoir with the applicator tip disposed at one end of the reservoir. The reservoir is preferably connected to an absorbent pad dispenser. Suitable laundry formulations for use in association with the device are also disclosed.

2. Description of the Related Art

Conventional laundering processes using automatic washing machines are known. When using conventional detergents, stains can be difficult to remove from laundry items. Stains such as motor oil, blood, coffee, ink, dirt, grass, etc can be difficult to remove. In order to effectively remove tough stain, it is desirable to pre-treat (or pre-spot) the stains before the laundry items are washed. Typically, a pre-spotting formulation is delivered to the stain and the formulation-treated stain is rubbed or scrubbed so that the stain is loosened, dislodged, or dissolved. Thereafter, the treated stain is effectively removed by one of the conventional laundering processes.

Devices and processes for pre-treating stains are also well known in the art. One currently marketed stain treatment device resembles a large felt tip marker in structure but which includes an applicator tip or nib that dispenses a clear stain-removing formulation from a reservoir. While this and other similar devices are suitable to treat small everyday stains on clothing, it is generally ineffective in treating large tough stains as the device does not include a scrubbing surface and is not suitable for scrubbing or rubbing the formulation-treated stains.

Another problem associated with current stain treatment devices is the lack of ability to effectively remove stains and excess formulation from the laundry item during the treatment. These devices merely function to "dilute" or "spread" the stains to make them less visible as opposed to removing the stains from the clothing. While the tough stains may be lighter than it was before treatment, it may still be difficult to completely remove the tough stains by a subsequently laundering process as the stains are not effectively loosened or dislodged.

In order to effectively remove the stains and excess formulation, efforts have been made to provide an absorbing mechanism to the current devices. The improved devices generally include an applicator disposed at one end for applying a stain removal formulation and an absorbent mechanism disposed at the other end of the device. These devices, however, fail to combine an effective stain removal formulation, an effective and efficient applicator tip and an effective absorbent pad mechanism. For example, while one such device includes discrete absorbent pads that may be used, broken off and discarded after they become discolored, the mechanism for advancing the pads out a pad holder is awkward and non-ergonomic. More importantly, the absorbent pads included in those devices does not have a stiff scrubbing surface and therefore cannot function to both distribute the formulation on the clothing and scrub the stains after the stains are saturated with the formulation.

Motorized stain removal brushes are also known in the art. These brushes, however, do not include a reservoir for containing a stain treatment formulation or an applicator for delivering the formulation to the stains. Moreover, the brushes do not include an absorbent member and therefore cannot absorb the loosened stains or excess formulation. Furthermore, as only one set of bristles is included in one brush, it cannot be quickly and conveniently replaced after the bristles are worn or damaged.

In addition to the stain removal applications discussed above, there is also a need for an applicator that delivers a functional formulation to a desired surface, distribute the formulation on the surface, and wicks off excess formulation from the surface. When the formulation is a surface cleaner, the applicator may further function to scrub or rub the formulation-treated surface to improve the cleaning performance thereof.

Hence, there is a need for a laundry pre-treating device that delivers an effective pre-spotting formulation to stains on laundry items and loosens the stains by scrubbing the formulation-treated stains before the laundry items are washed in a conventional laundering process. Further, there is a need for an applicator that conveniently applies a functional formulation to a washable article. Still further, there is a need for an applicator that includes an plurality of absorbent scrubbing pads that is conveniently dispensed and each functions to engage the formulation-treated surface thereby either cleaning the surface or wick the formulation from the surface, or both.

SUMMARY OF THE DISCLOSURE

In satisfaction of the aforenoted needs, an improved device for applying a functional formulation to a variety of surfaces is disclosed. In one embodiment, the functional formulation is a laundry pre-spotting formulation. In another embodiment, the functional formulation is selected from the group consisting of insect control agents, upholstery cleaners, glass cleaners, electronic device cleaners, bathroom fixture cleaners, wood cleaners, wood scratch coverers, floor cleaners, and fragrances.

In one embodiment the disclosed device comprises a fluid reservoir in communication with an applicator valve assembly. Preferably, the device also includes a shell connected to the reservoir for housing an absorbent material. The fluid reservoir contains the functional formulation.

In a refinement, the shell comprises an opening through which the absorbent material may extend to engage and scrub the formulation-treated surfaces and absorb, wick or lift excess formulation and/or loosened soils and stains from the surface.

In another refinement, the absorbent material is provided in the form a plurality of pads mounted on a circular frame or wheel that can rotate within the shell permitting the exposure of one pad at a time through the opening on the shell. Rotation of the wheel results in the exposure of a fresh pad through the opening on the shell.

In another refinement, the absorbent material is provided in the form a ring or disk that rotates within the shell permitting the exposure of part of the material at any given time through the opening on the shell.

Other means for dispensing fresh absorbent pads includes a stack of pads that emerge from an opening one at a time or a pad structure whereby a soiled or wet portion of the pad structure can be separated and removed.

In a refinement, the absorbent pad comprises matted fibers or fibers having a random or non-discernible orientation. In a related refinement, the pads comprise polyester felt material. When scrubbing or rubbing is needed, the absorbent pad preferably includes a stiff scrubbing surface. The absorbent pads may be washed and reused, or otherwise discarded and replaced with a new set of pads.

In a refinement, discreet pads are mounted onto a ring shaped frame. In another refinement, the pads are integral with a ring shaped frame that forms a one-piece, gear-shaped absorbent member.

In any of the embodiments, the absorbent pads may be covered with a protective cap or cover, either completely removable or hinged to the shell.

In yet another refinement, the structure of the device may be easily disassembled so that a fresh set of absorbent pads may be installed. Such disassembly also provides easy refilling of the reservoir with the functional formulation or installation of a new reservoir containing the functional formulation when the formulation is depleted after one or more applications.

In another refinement, the reservoir body is translucent or see-through so that the user can easily determine the amount of the functional formulation remaining in the reservoir.

In another refinement, the applicator valve assembly comprises a restrictive flow element that provides communication between the fluid reservoir and a throttle element. The throttle element comprising an exit orifice through which the formulation is delivered. Movement of the throttle and restrictive flow element relative to each other controls flow between the reservoir and exit orifice.

In a refinement, rotation of the throttle element with respect to the restrictive flow element permits or prevents flow through the restrictive flow element. In yet another related refinement, the throttle element rotates between an "off" position where fluid communication between the reservoir and orifice is prevented and an "on" position where fluid communication from the reservoir to the exit orifice is established.

In a different refinement, axial movement of the throttle element with respect to the restrictive flow element permits or prevents flow through the restrictive flow element. In a related refinement, the throttle element moves axially towards the restrictive flow element and into an "off" position where fluid communication between the reservoir and orifice is prevented and axially away from the restrictive flow element to an "on" position where fluid communication from the reservoir to the exit orifice is established.

In a refinement, the restrictive flow element comprises a restrictive flow conduit in communication with the reservoir. The diameter of the conduit is preferably dependent on the dimension of the applicator, capacity of the fluid reservoir, and the thickness of the formulation.

In another refinement, the restrictive flow element is mateably received within an open end of the fluid reservoir. In a related refinement, the restrictive flow element is also mateably received within the throttle element. In such a refinement, the open end of the reservoir is disposed opposite the reservoir from the shell that houses the absorbent material.

The valve assembly comprises a nozzle connected to the outlet of the reservoir. The nozzle accommodates a porous flow restrictor. An o-ring seal prevents fluid communication between the reservoir and the exit orifice of the throttle when the throttle is moved axially towards the reservoir. Movement of the throttle axially away from the reservoir releases the seal and permits communication from the reservoir, through the flow restrictor and nozzle and out the exit orifice of the throttle.

As an alternative to the valve assemblies discussed above, check valves, duckbill valves, flapper valves, cross-slot diaphragm valves, etc., may also be employed. Further, another option for the applicator tip may be a porous plastic material or porous foam. In yet another refinement, the restrictive flow element may simply comprise one or more restrictive flow tubes, conduits or channels the provide communication between the fluid reservoir and the exit orifice. In such an embodiment, a cap or cover would be needed.

Preferably, the reservoir and absorbent material shell, in combination, are ergonomically shaped. In one embodiment, the reservoir and shell are connected in a coaxial configuration. In another embodiment, the reservoir and shell are attached together in a side-by-side configuration.

In another refinement, the shell comprises an actuator that engages the absorbent material. In one embodiment, the actuator is a dial comprising an outwardly protruding lip to facilitate rotation of the dial and absorbent material. In a related refinement, the dial includes a downwardly extending cylindrical wall that is frictionally and mateably received within the pad ring so that rotation of the dial results in rotation of the pad ring.

In another refinement, the pads are detachable from a frame or disk and may be discarded when they become used or discolored. As one alternative, the pads remain on the disk or frame and are rotated back into the shell after they are worn, damaged, soiled, or discolored.

In another refinement, the absorbent pads may be ejected from the opening of the shell or pulled off by a sidewall of opening of the shell when the ring shaped frame or disk is rotated.

Methods for pre-treating stains on laundry items before the laundry items are washed in a conventional laundering process are also disclosed. Such methods comprise using the disclosed applicator valve assembly to deliver the pre-spotting formulation to the stain followed by using the absorbent scrubbing pad to distribute and work the formulation into the stain, scrub the formulation-saturated stain, and/or absorb or wick excess formulation from the laundry item before the laundry items are washed.

In another refinement, a multi-reservoir device may be provided that includes two or more different pre-spotting formulations, each suitable for particular type(s) of stains. Such a multi-reservoir device may be provided with one or more applicator valve assemblies.

Alternatively, the disclosed device may be modified to be suitable for applications including, but not limited to, upholstery cleaning, glass cleaning, bathroom fixture cleaning, furniture care, floor care, insect control agent delivery, and fragrance delivery. In such cases, the device includes a functional formulation suitable for one or more intended applications.

In some embodiments, the formulation comprises water and one or more surfactants. Preferably, the one or more surfactants are selected from the group consisting of anionic surfactants, cationic surfactants, nonionic surfactants, amphoteric surfactants, and mixtures thereof. The formulation may also include one or more organic solvents including alcohols such as ethanol and/or hydrocarbon solvents such as limonene.

The formulation may include one or more active ingredients to further improve the stain treatment performance thereof. Such active ingredients may include, but are not limited to bleaches, oxidants, enzymes, and caustic bases. The pre-spotting formulation preferably includes an acid such as citric acid.

The formulation may further include additional adjuvants including, but not limited to, fragrances, thickeners, anti-formers, preservatives, chelating agents, etc. Other formulation suitable for use in association with the disclosed device would be apparent to one of ordinary skill in the art and should be considered within the scope of this disclosure.

Other advantages and features will be apparent from the following detailed description when read in conjunction with the attached drawings. It will also be noted here and elsewhere that the devices disclosed herein can be used to apply fluids other than stain treatment fluids.

BRIEF DESCRIPTION OF THE DRAWINGS

For a more complete understanding of the disclosed methods and apparatuses, reference should be made to the embodiments illustrated in greater detail in the accompanying drawings, wherein:

FIG. 9 is another partial sectional view the valve assembly shown in FIG. 8, particularly illustrating the valve assembly in an "off" or closed position;

FIG. 10 is a partially sectional view illustrating the ring of absorbent pads, shell and actuator for the device shown in FIGS. 1-9 and 12-13;

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein and further that the devices disclosed herein can be used to apply fluids other than stain treatment fluids.

DETAILED DESCRIPTION OF THE PRESENTLY PREFERRED EMBODIMENTS

Figure 11:
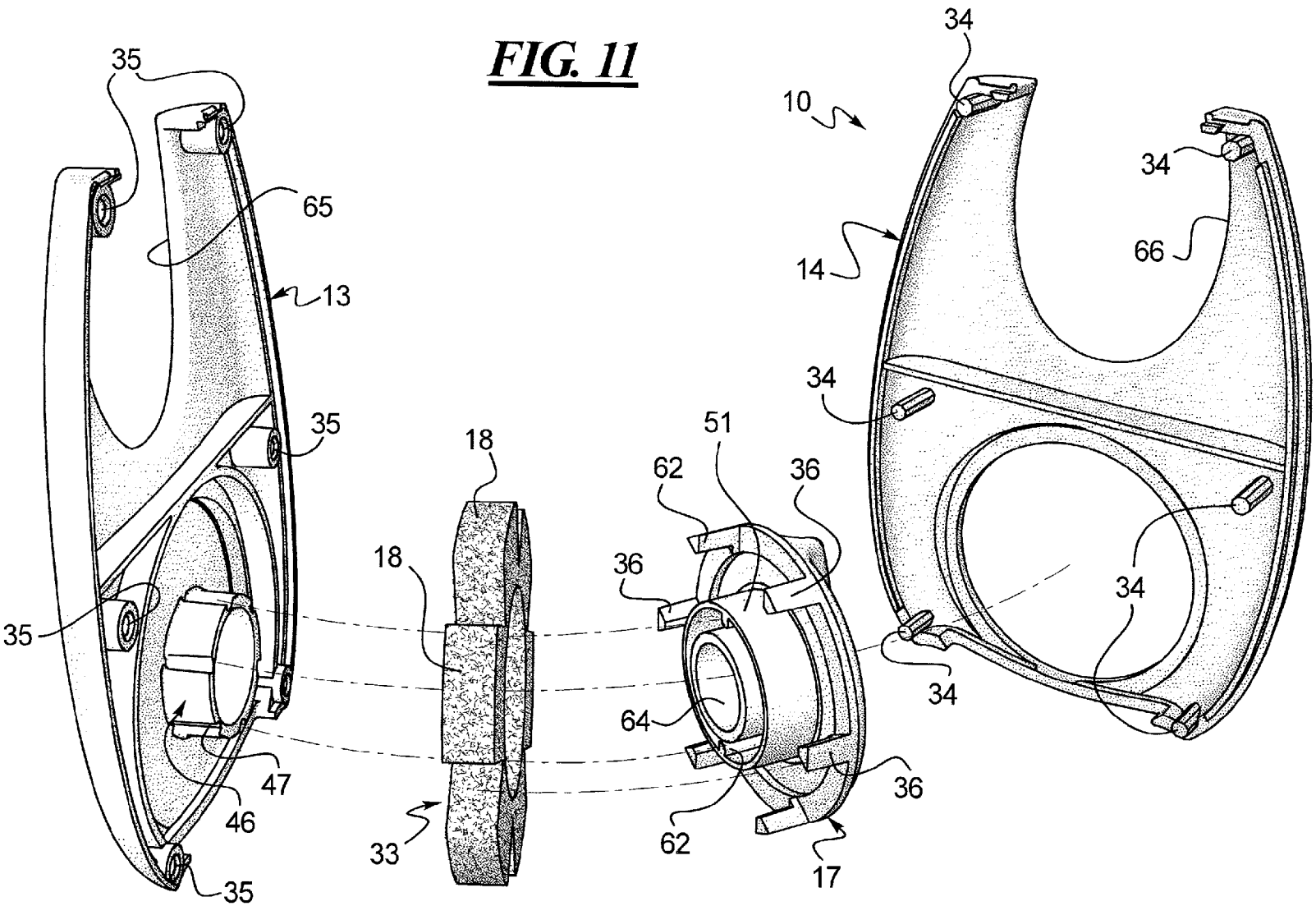
FIG. 11 is an exploded view illustrating the ring of absorbent pads, shell and actuator for the device shown in FIGS. 1-10 and 12-13.
Figure 12:
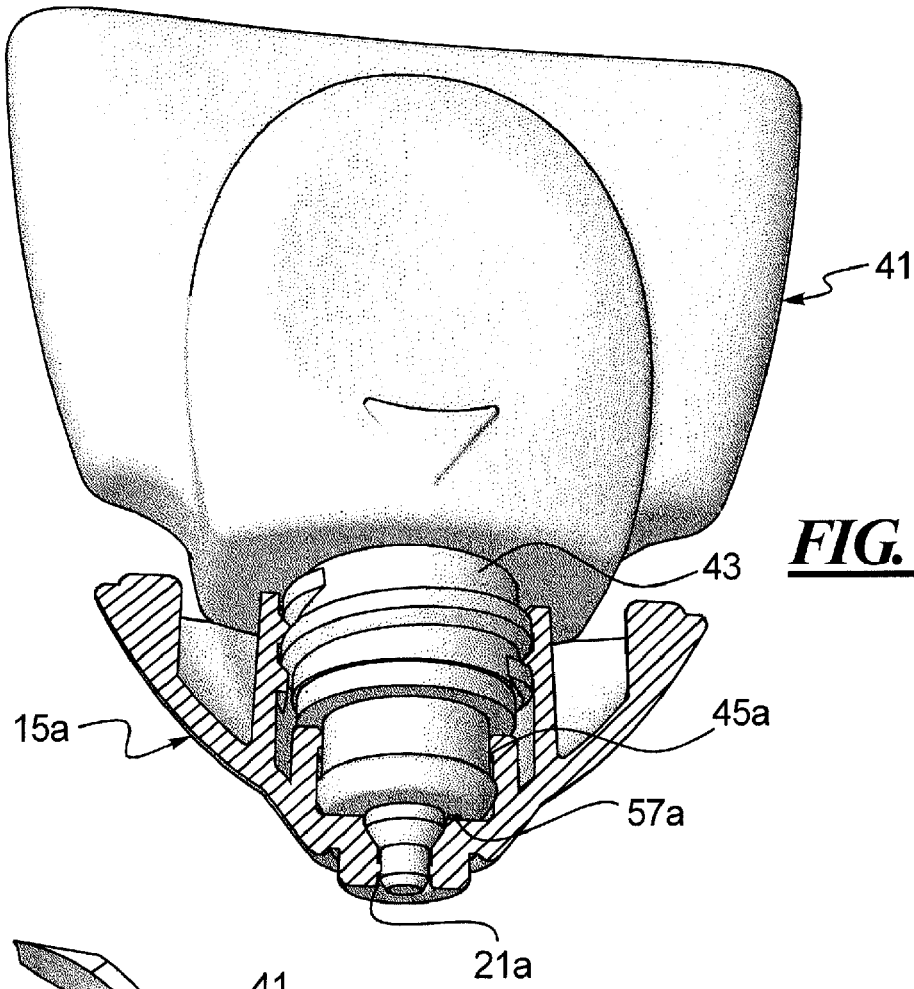
FIG. 12 is a partial sectional view of another valve assembly made in accordance with this disclosure, particularly illustrating the valve assembly in an "off" or closed position.
Figure 13:
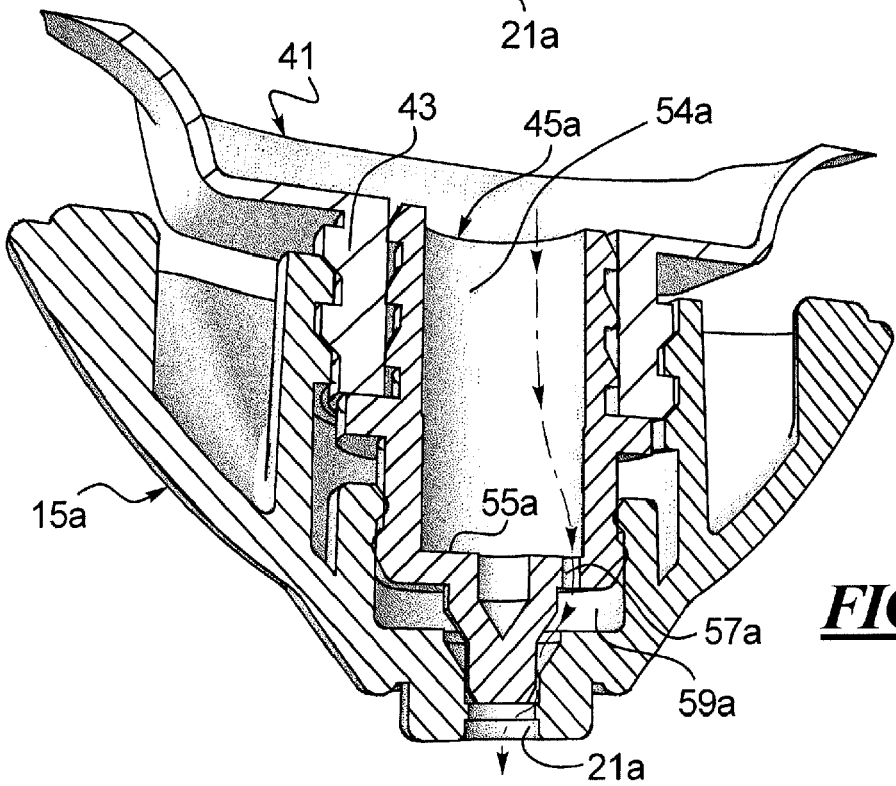
FIG. 13 is another partial sectional view of the valve assembly shown in FIG. 12, particularly illustrating the valve assembly in an "on" or open position.
Figure 14:
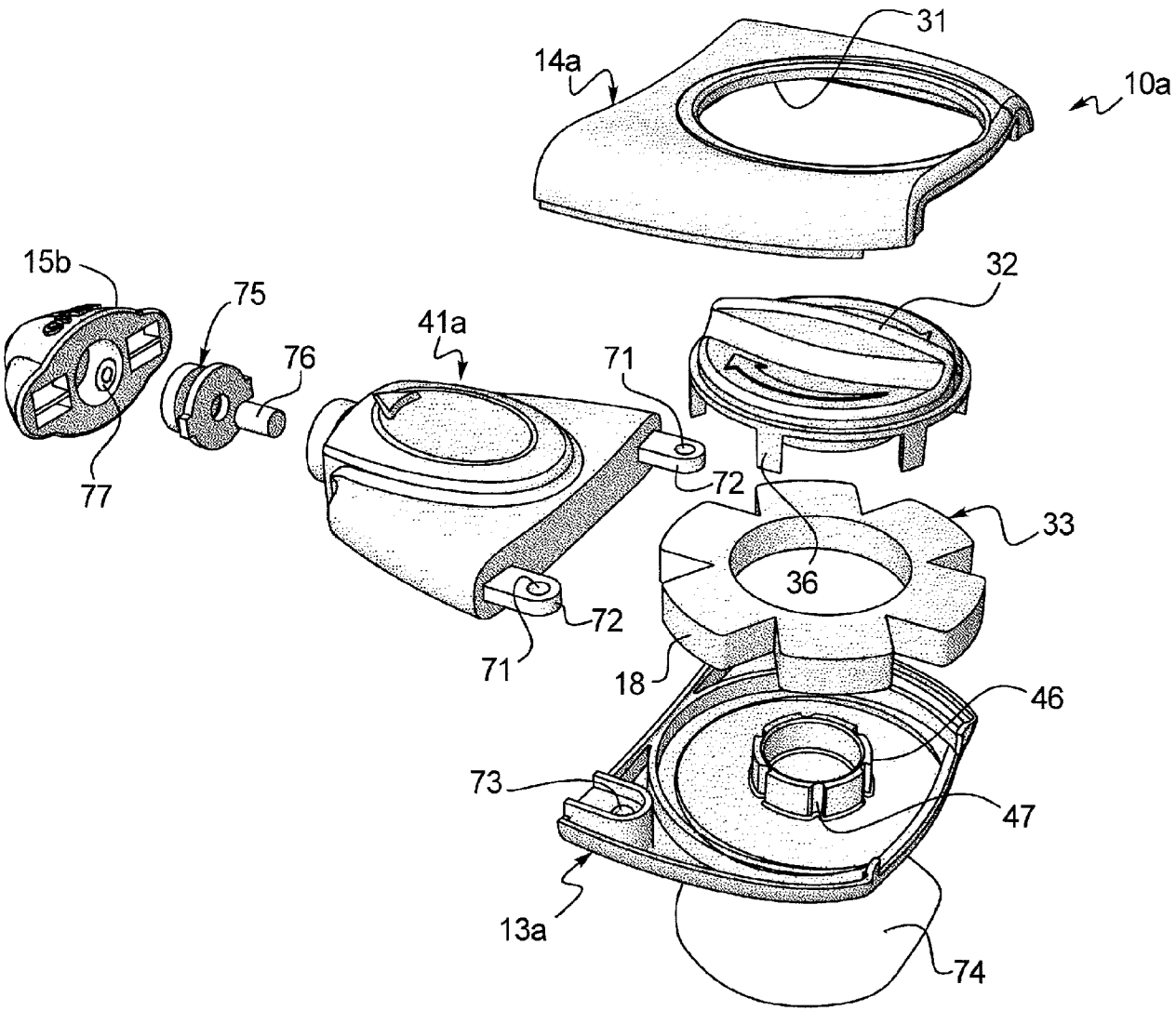
FIG. 14 is an exploded view of an alternative stain treatment device.
Figure 15:
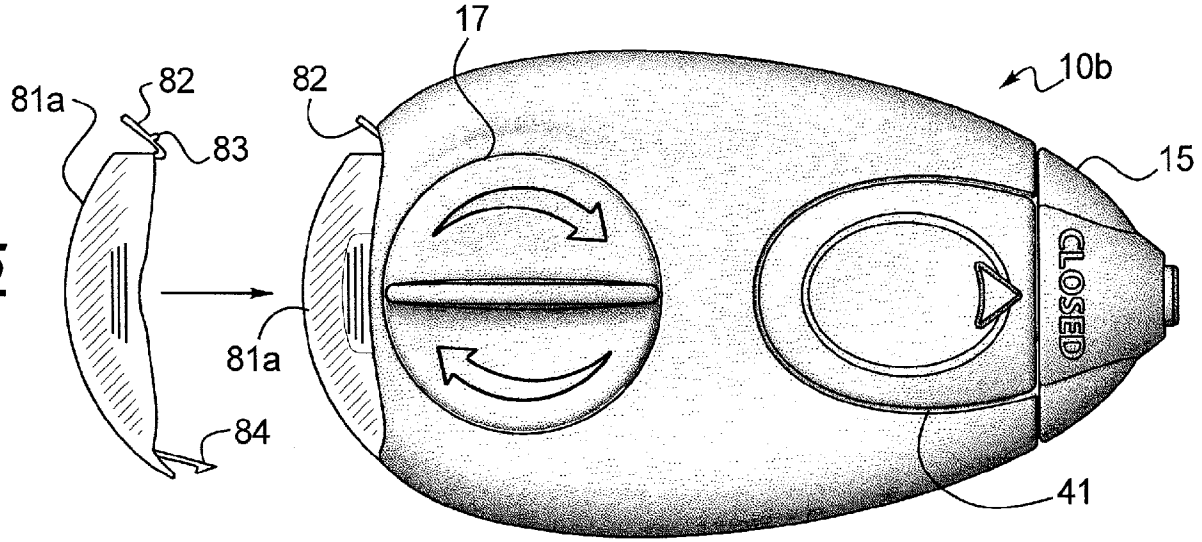
FIG. 15 is a plan and partial exploded view of yet another stain treatment device that includes a cap or cover for the absorbent pads.
Figure 16:
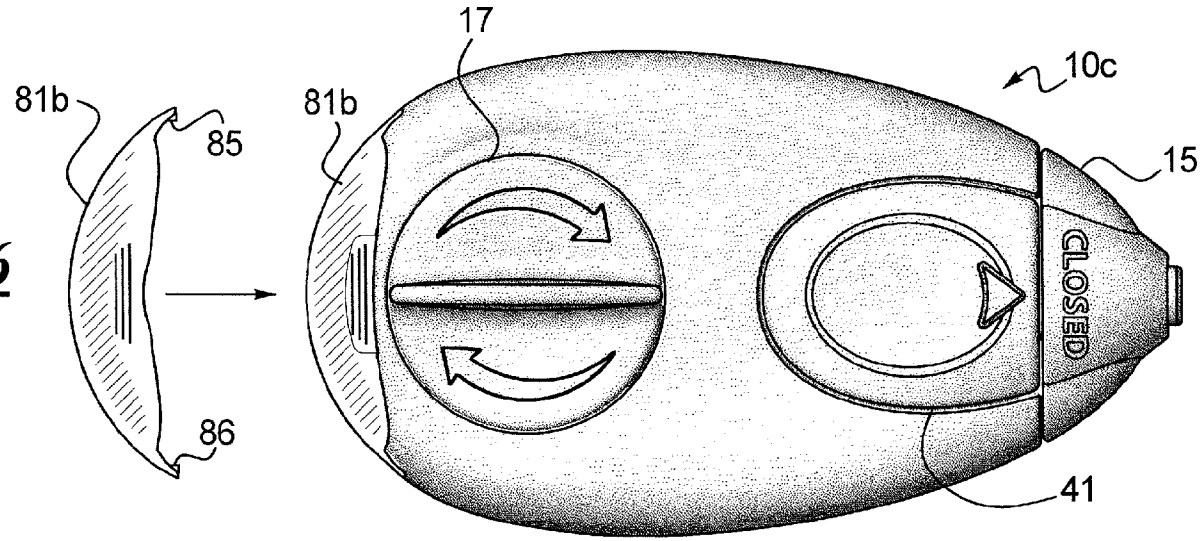
FIG. 16 is a plan and partial exploded view of yet another stain treatment device that includes a cap or cover for the absorbent pads.

An exemplary applicator or device for applying the functional formulation to a surface is illustrated in FIGS. 1-13, with one type of valve assembly illustrated in FIGS. 4 and 6-9 and a second type of valve assembly illustrated in FIGS. 12-13. A third type of valve assembly and a structurally different embodiment is illustrated in FIG. 14 and two types of end caps or covers for the absorbent pads are illustrated in FIGS. 15-16.

The disclosed applications are particularly useful for applying laundry products to washable fabrics. However, the disclosed applications are suitable for a host of other uses such as upholstery cleaning, glass cleaning, bathroom fixture cleaning, furniture care, floor care, insect control agent delivery, and fragrance delivery. In such cases, the device includes a functional formulation suitable for one or more intended applications.

Figure 1:
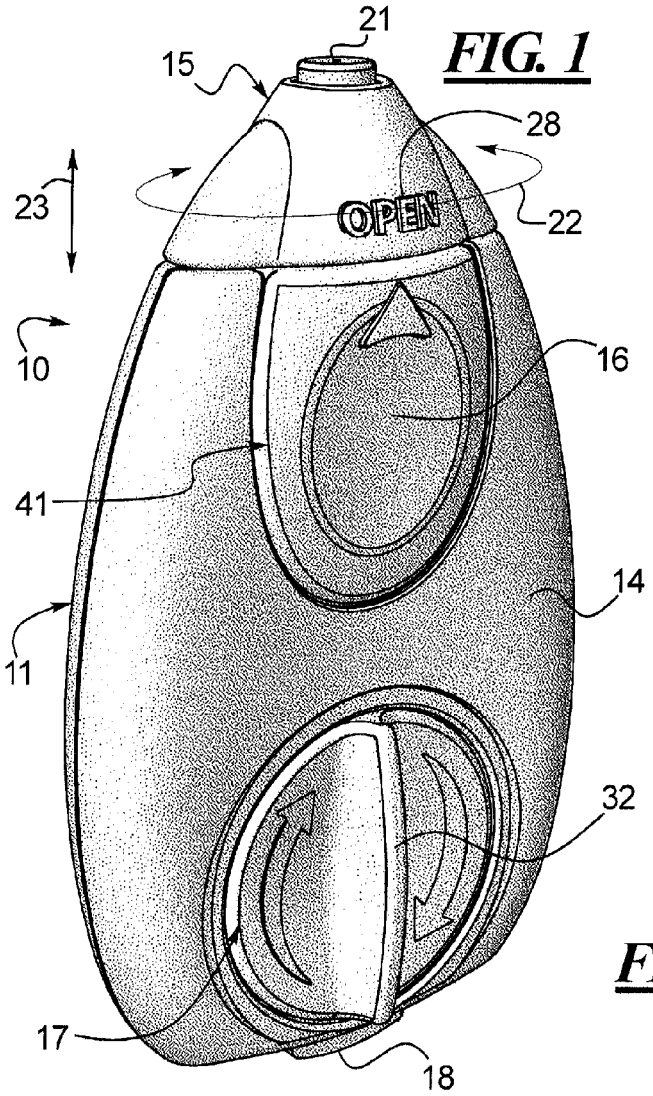
FIG. 1 is a front perspective view of an instant stain removing device equipped with an absorbent means in accordance with this disclosure.
Figure 3:
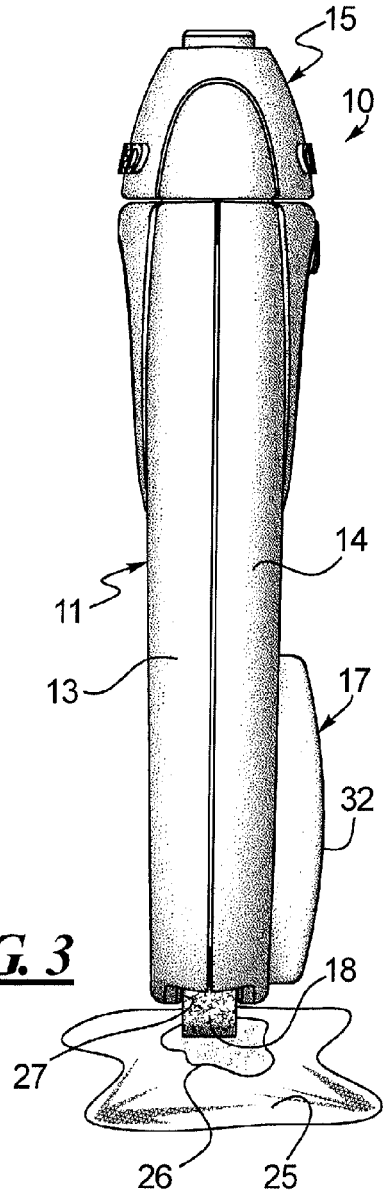
FIG. 3 is a side plan view of the device shown in FIGS. 1 and 2.
Figure 2:
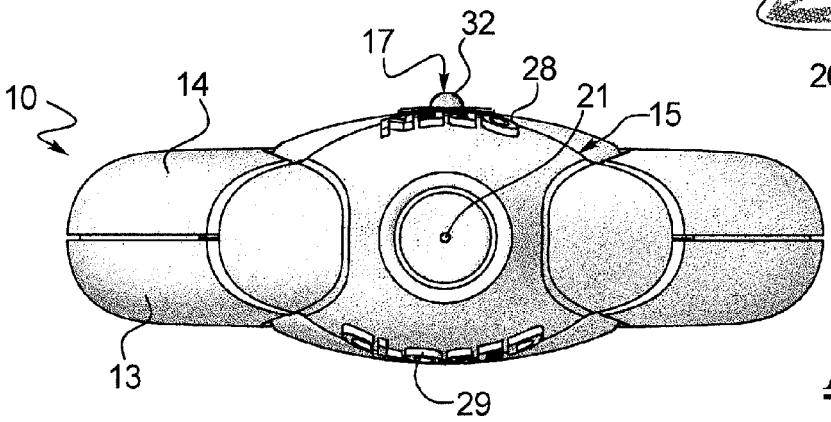
FIG. 2 is a top plan view of the device shown in FIG. 1.
Figure 4:
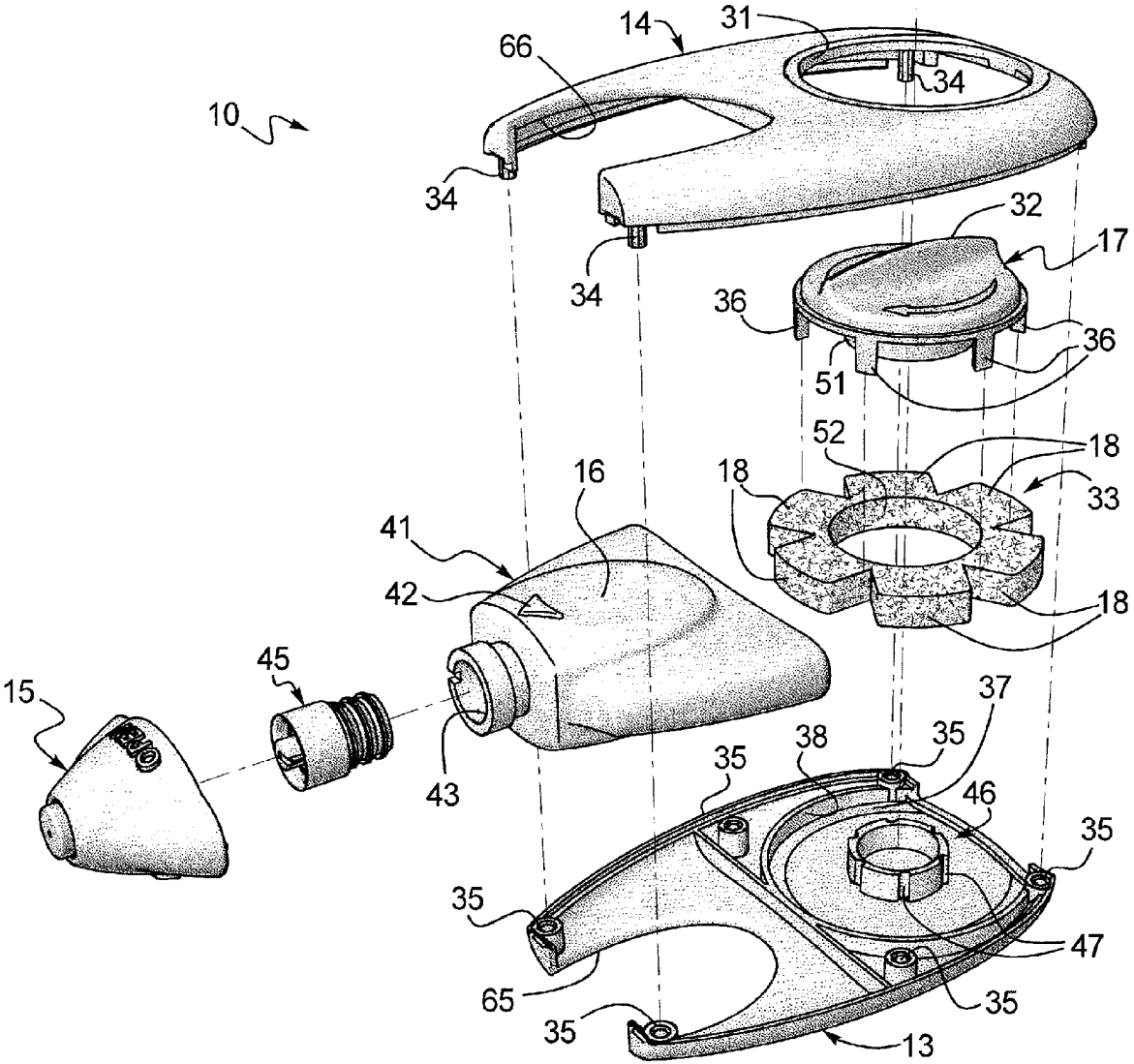
FIG. 4 is an exploded view of the device shown in FIGS. 1-3.

Turning first to FIG. 1, the applicator device 10 includes an outer housing 11 that, as shown in FIGS. 2-4, comprises two molded and mating halves or half-shells 13, 14. It may be desirable to detachably connected the half-shells 13, 14 together to replace the fluid reservoir 41 and/or absorbent pads 33 as discussed below in connection with FIG. 4. Returning to FIG. 1, the applicator 10 also includes a throttle element 15 which forms part of a valve assembly described below, a flexible wall 16 of the reservoir 41 adapted to be squeezed so that the functional formulation can be forced out of the reservoir 41, and an actuator 17 for dispensing an absorbent pad 18 through an opening in the shell or housing 11.

As best seen in FIG. 2, the throttle element 15 includes an exit orifice 21 through which the formulation is delivered when the valve assembly is moved to an open, on or dispense position as described below. As also described below, three types of valve assemblies are provided. The first type of valve assembly described in FIGS. 4 and 6-9 includes a throttle element 15 that rotates in either direction as indicated by the arrow 22 shown in FIG. 1. A second valve assembly provides a different throttle element design that requires axial movement of the throttle element as indicated by the arrow 23 shown in FIG. 1 and described below in connection with FIGS. 12-13. Another valve assembly that utilizes axial movement is described in FIG. 14.

In general application, the throttle element 15 of the applicator 10 is opened and the formulation contained in the reservoir 41 is delivered through the exit orifice 21 (FIGS. 1-2) to the surface to be treated (FIG. 3). Then, the applicator device 10 is rotated and the pad 18 is applied to the moistened area 26 to either frictionally engage the treated surface or to absorb excess formulation from the surface, or both. As seen in FIG. 3, the pad 18 extends outward through an open end or opening 27 in the housing or shell 11. As seen in FIG. 2, helpful indicia are provided at either side of the rotating-type throttle element 15. As seen in FIG. 1, the indicium 28 indicating that the throttle element 15 is in an open position is disposed along the same side as the flexible wall or pump 16 and actuator 17. The same configuration is shown in FIG. 2. As seen in FIG. 2, the indicium 29 indicating that the throttle element is in a closed position is disposed on the opposite side of the housing 11 from the actuator 17 so as not to cause any confusion.

Turning to FIG. 4, the housing or shell includes a top portion 14 with an opening 31 for accommodating the actuator 17. The actuator 17 includes an upwardly protruding thumb or finger grip 32 to facilitate the rotation of the actuator 17 and the ring 33 of absorbent pads 18. The ring 33 of pads 18 maybe integrally formed as shown in FIG. 4 or may include a ring-shaped frame with separate pads 18 mounted thereon. The shell half 14 includes downwardly extending pegs 34 that mate with openings 35 on the lower shell half 13. The actuator 17 also includes downwardly extending pegs 36 that ride along in the track 37 formed in the lower shell half 13. The lower pegs 36 include a triangular-shaped cross-section and are accommodated between the pads 18 as shown by the phantom lines in FIG. 4. The ring 33 of pads 18 fits within the wall 38 of the lower shell half 13. A frictional/mateable engagement occurs between the cylinder 51 of the actuator 17 and the inner surface 52 of the absorbent pad ring 33.

The fluid reservoir is shown at 41 and includes a built-in pump 16 or flexible wall. The indicium 42 makes it clear to the user which direction the fluid will flow when the applicator 10 is moved to the open position. The reservoir 41 is fabricated from a flexible material and includes an open end 43 which receives a restrictive flow element 45 that, with the throttle element 15 forms a valve assembly. Preferably, the reservoir 41 is translucent or clear so the user is aware of the amount of formulation remains in the reservoir 41.

The restrictive flow element 45 and throttle element 15 will be described in greater detail below in connection with FIGS. 6-10. Finally, in connection with FIG. 4, the cylindrical wall 46 disposed on the lower shell half 13 includes a plurality of recesses 47 that interact with the actuator 17 to provide a clicking sound to ensure the user that one of the pads 18 is centrally disposed within the opening 27.

Figure 5:
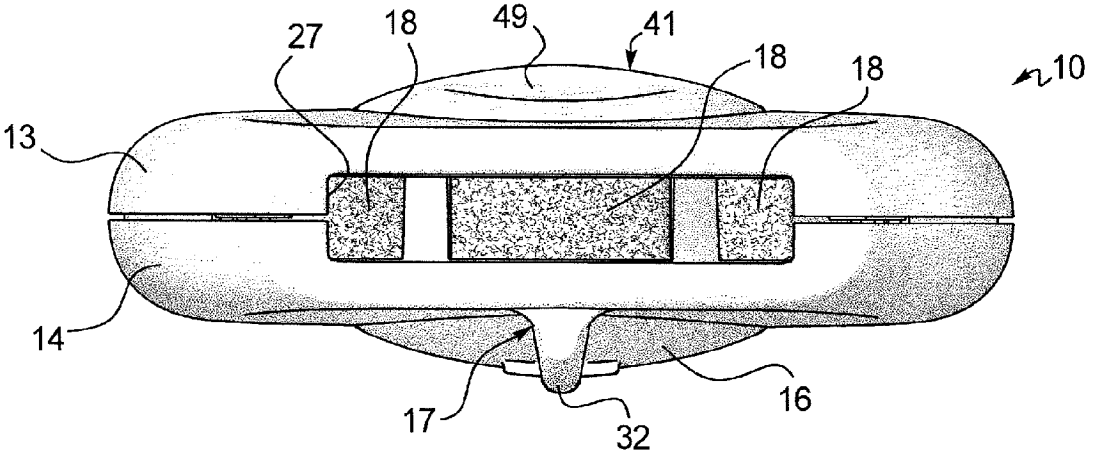
FIG. 5 is a bottom plan view of the device shown in FIGS. 1-4.

Turning to FIG. 5, a bottom view of the applicator 10 is shown whereby the actuator 17 has been rotated so that a single pad 18 is centrally located within the opening 27 formed by the lower and upper shell halves 13, 14 respectively. Also shown in FIG. 5 is a lower pumping element or flexible wall 49 to complement the action of the upper pumping element or flexible wall 16.

Figure 6:
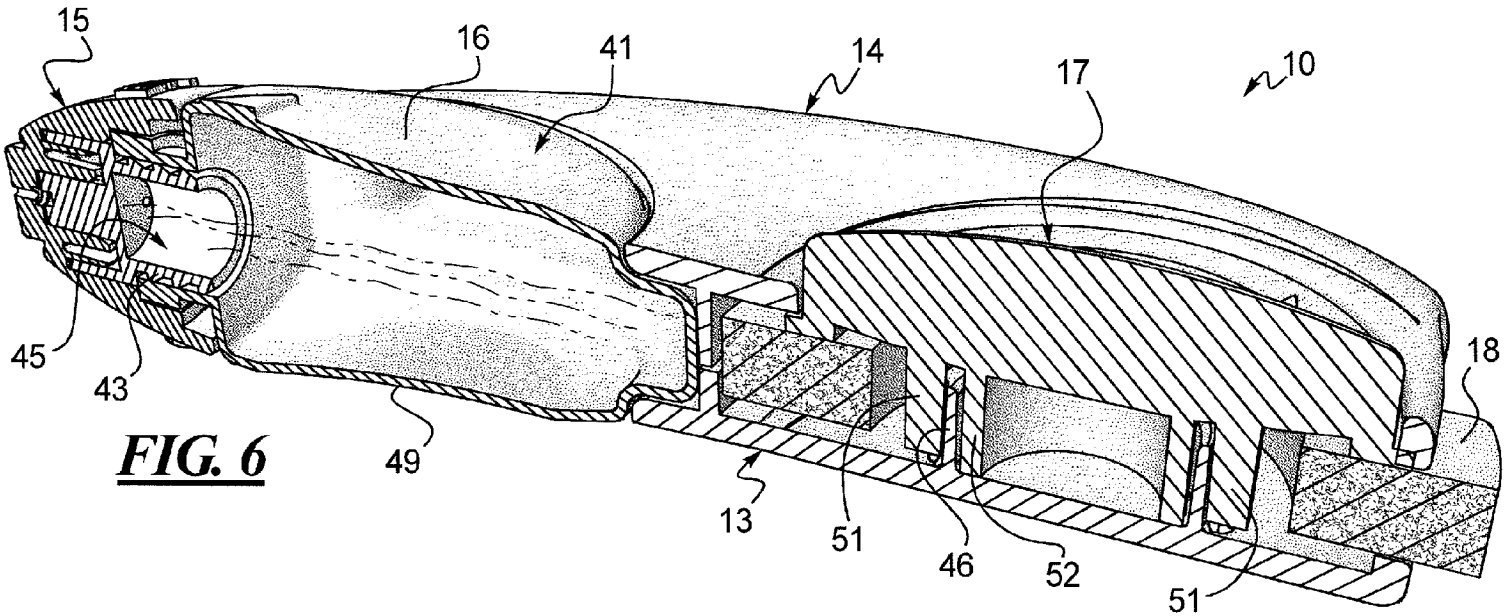
FIG. 6 is a perspective side sectional view of the valve assembly, reservoir and absorbent pad dispensing means shown in FIG. 4.

Still referring to FIG. 6, the downwardly extending pegs 36 of the actuator 17 frictionally engage the upwardly extending cylindrical wall 46 mounted on the lower shell half 13. The downwardly extending cylindrical wall 52 of the actuator 17 is received within the wall 46 of the shell half 13 as shown. Frictional engagement between the wall 51 and the recesses 47 of the wall 46 (See FIG. 4) provide an audible clicking sound or a sensation to the thumb or finger to signal to the user that the pad 18 is centrally located within the opening 27 as explained in greater detail below in connection with FIG. 11. The area of the housing 11 accommodating the pads 18 can be referred to as the shell and the reservoir 41 can also be a part of the housing 11 but, as shown in FIGS. 1-6, and 14, the reservoir 41 is a separate, flexible element that, like the absorbent pad ring 33, can be replaceable.

Figure 7:
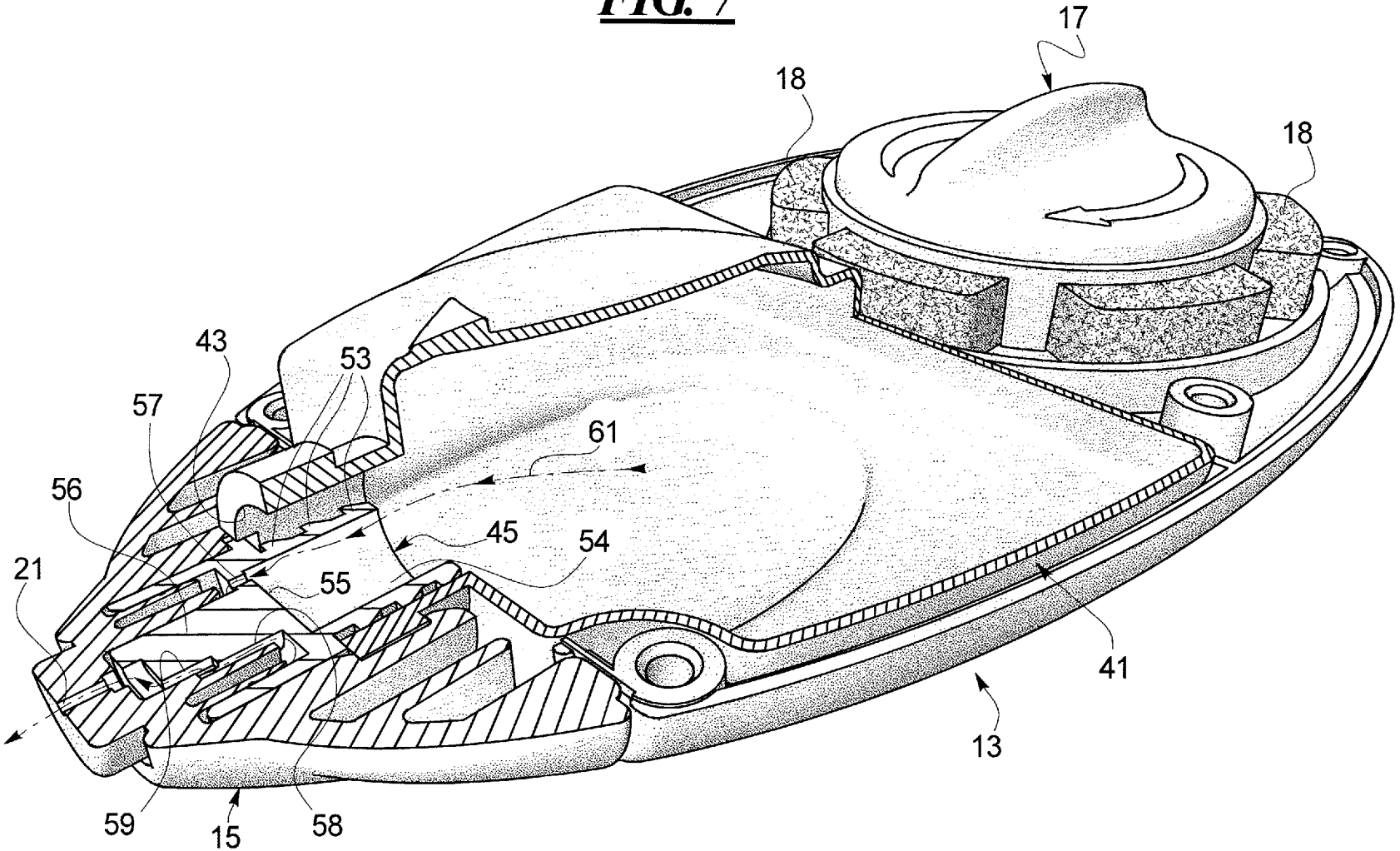
FIG. 7 is a another perspective sectional view of the device shown in FIG. 6.

FIG. 6 also illustrates a restrictive flow element 45 which is mateably received within the opening 43 of the reservoir 41. FIG. 6 also illustrates that the restrictive flow element 45 is mateably received within the throttle element 15. This relationship is illustrated in greater detail in FIGS. 7-9. Turning to FIG. 7, the restrictive flow element 45 is mateably received within the opening 43 of the reservoir 41. The outer annular barbs or ridges 53 enhance this frictional engagement and provide a sealing function as well. The restrictive flow element 45 includes a cylindrical portion 54 that terminates at a wall 55 of a solid end 56 but which has a through hole shown at 57. When the throttle 15 has been rotated to the open position as shown in FIG. 8, communication is established between the through hole 57 and the channel 58 opposite the solid structure 56.

Figure 8:
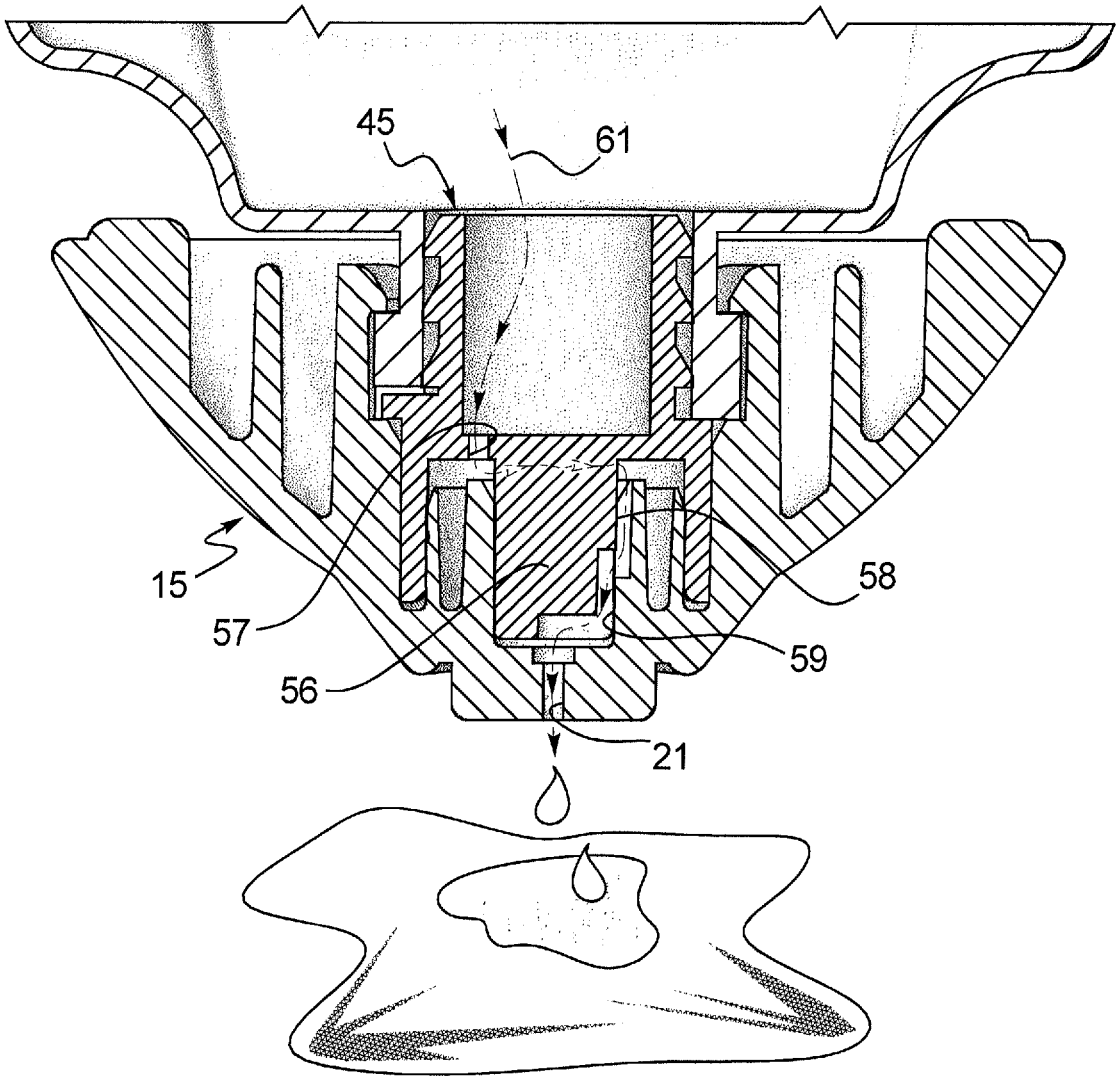
FIG. 8 is a partial sectional view of one embodiment of a valve assembly as shown in FIGS. 4 and 6-7, particularly illustrating the valve assembly in an "on" or open position.

Thus, referring to the flow path shown by the line 61 of FIGS. 7-8, when the throttle 15 is in the position shown in FIGS. 7 and 8, pressure applied to the reservoir 41 will result in the formulation migrating along the path 61, through the through hole 57, through the channel 58, through the connecting channel 59 and out the exit orifice 21 of the throttle element 15. Thus, in the open position shown in FIGS. 7 and 8, communication between the through hole 57 of the restrictive flow element 45 and the connecting channel 59 of the restrictive flow element 45 is provided by the channel 58 of the throttle element 15.

However, to close the valve assembly 15/45, the throttle element 15 is rotated thereby rotating the channel 58 of the throttle element 15 out of communication with the connecting channel 59. Thus, in the position shown in FIG. 9, the through hole 57 and the connecting channel 59 are isolated from one another and communication between reservoir 41 and exit orifice 21 is prevented. To reestablish communication, the throttle element 15 is rotated back to the position shown in FIGS. 7 and 8 whereby the channel 58 provides communication between the through hole 57 and connecting channel 59.

FIG. 10 illustrates the relationship between the downwardly extending cylindrical wall 51 of the actuator 17 and the upwardly extending cylindrical wall 46 of the lower shell 13. The wall 46 of the shell 13 includes recesses 47. The wall 51 of the actuator 17 includes complementary protuberances 62 which are received within the recesses and provide a clicking sound when they either enter or exit a recess 47, thereby signaling to the consumer that the pad 18 is centrally located within the opening 27. The protuberances 62 of the wall 51 are illustrated in greater detail in the exploded view of FIG. 11.

FIG. 11 also illustrates the complimentary truncated triangle cross section of the downwardly extending pegs 36 which fit between the adjacent absorbent pads 18 of the pad ring 33. As also shown in FIG. 11, the actuator 17 includes an inner cylindrical wall 64 that is mateably received within the cylindrical wall 46 of the lower shell 13. Thus, the wall 46 of the shell 13 is sandwiched between the walls 64 and 51 of the actuator 17. The recesses shown at 65, 66 in the shells 13, 14 accommodate the pump elements 49, 16 of the reservoir 41 respectively.

Another valve assembly **15*a*/45*a* is illustrated in FIGS. 12 and 13. Instead of a rotating throttle member 15*a*, the throttle member 15*a* moves axially with respect to the restrictive flow element 45*a*. Specifically, the restrictive flow element 45*a* also includes a cylindrical section 54*a* that terminates at an end wall 55*a* (See FIG. 13). The restrictive flow element also includes a through hole 57*a*. The through hole 57*a* provides communication between the reservoir 41 and the exit orifice 21*a* when the throttle element 15*a* has been moved axially away from the reservoir 41 or downward from the perspective shown in FIG. 13**.

In the position shown in FIG. 13, the through hole **57*a* is in communication with the connecting passageway 59*a* which, in turn, is in communication with the exit orifice 21*a* as shown in FIG. 13. In the closed position shown in FIG. 12, the through hole 57*a* is covered by the body of the throttle element 15*a* thereby preventing communication through the restrictive flow element 45*a***.

Turning to FIG. 14, yet another device 10*a* is disclosed with differently configured half shells 13*a*, 14*a* which may be connected to the reservoir 41*a* by fasteners (not shown) extending through the through-holes 71 of the tabs 72 of the reservoir 41*a* and complementary holes, only one of which is shown at 73 in behalf shell 13*a*. In this embodiment, the reservoir 41*a* and absorbent pad ring 33 may be replaced with relative ease. A label is shown at 74.

FIG. 14 also discloses a different valve assembly which includes a throttle or tip 15*b*, a nozzle 75 which may be press-fit or permanently connected to the reservoir 41*a*, and a flow restrictor 76, typically fabricated from a polymer tubular material such as HDPE, one example of which is POREX®, having a 35 μm diameter flow path (not shown). The O-ring 77 provide to seal when the throttle or tip 15*b* is moved axially towards the reservoir 41*a*.

FIGS. 15-16 both show different styles of caps or covers 81*a*, 81*b* that may be employed for covering the absorbent pads 18. The cover 81*a* of the device 10*b* of FIG. 15 is equipped with a release handle 82 and release tab or catch 83 as well is a barbed leg 84. The cover 81*b* of the device 10*c* includes two nibs 85, 86 that simply snap into place as shown in FIG. 16.

Thus, at least three types of valve assemblies 15/45, 15*a*/45*a*, 15*b*/77/75/76 are shown and described in detail. A simple cap or cover for the reservoir 41 with a small or restrictive opening will also suffice. The first valve assembly 15/45 includes a rotating throttle element 15 and the second and third types of valve assemblies 15*a*/45*a* and 15*b*/77/75/76 include a throttle element 15*a*, 15*b* that moves axially with respect to the restrictive flow element or nozzle 45*a*, 75. However, other types of valve assemblies will be apparent to those skilled in the art as discussed above in the summary of the disclosure section.

The absorbent material 18 may be obtained from Filtrona Richmond, Inc. of Colonial Heights, Va. (http://www.filtronafibertec.com/BondedFiberComponents/). The fibers themselves may be fabricated from various polyesters, polypropylene, wool, polyolefins, cellulose acetates and other similar materials. Additional information regarding suitable fibers and absorbent pads may be obtained from the manufacturer. Polyester felt material has also been found to be useful and can be attained from a variety of different manufacturers. In some embodiments, the absorbent material is preferably washable and and/or reusable. In other embodiments, the absorbent material is simply discarded and replaced when worn, damaged, soiled or discolored.

The devices 10, 10*a* can be designed to be disposable or designed to have the reservoirs 41, 41*a* and/or the absorbent pad rings 33 replaceable.

In a general pretreatment application, the pre-treating formulation contained in the device is delivered to the stains, and the formulation-saturate stains are loosened or dislodged by rubbing the stains with the absorbent pad. As the stained fabric is preferably not worn by a consumer during the pretreatment, and as the pre-treated laundry item is preferably laundered and rinsing shortly after the pretreatment, relatively strong formulations are preferably used in association with the device.

The stain loosening or dislodging performance of the stain pretreatment device may be further improved by providing a stiff scrubbing surface to the absorbent pads for rubbing the pre-spotting formulation into the stains and/or scrubbing the stains out of the surface of the laundry item. Such a scrubbing surface, on the other hand, is preferably not included in the device intended for delicate surfaces, such as human skin and smooth surfaces that are easily scratched.

Thus, the pre-treating device combines a dispensing chamber containing the pre-spotting formulation with an absorbent pad isolated from the dispensing chamber. The absorbent pad preferably includes a stiff scrubbing surface that functions as a "shovel" to scrub the stains out of the surface of the laundry item after the stains are saturated with the pre-treating formulation.

As the scrubbing progresses, a substantial portion of the pre-treat formulation may be dislocated to unstained areas, rendering the stained area relatively "dry" and any subsequent scrubbing ineffective. The absorbent pad then functions as controller to take up the dislocated formulation and redistributing it to the stained area, thereby not only preventing the unnecessary waste of delivering more fresh formulation to the stained area but also containing the contamination of the unstained area by any stain-containing formulation.

As a result of this dual function absorbent pad, effective and localized removal of large tough stains, such as those of used motor oil, blood, coffee, dirt, grass, or lard, from the fabric can be achieved before the laundry item is washed by a conventional laundering process, which alone may not be sufficient to effectively remove all of the large tough stains. Moreover, as the absorbent pad is isolated from the dispensing chamber, contamination of the formulation contained in the dispensing chamber is prevented.

As discussed above, the pre-treating cleaning device preferably includes a scrubbing surface. In one embodiment, the scrubbing surface is simply the outer surface of the absorbent pad, which is made of a stiff absorbent material. In another embodiment, the scrubbing surface is provided by integrating or attaching a scrubbing layer made of a stiff absorbent material to the outer surface of the absorbent pad. Materials suitable for forming the scrubbing surface are well known in the art and should be considered within the scope of this disclosure.

Furthermore, the disclosed device or modifications thereof may also be suitable for applications other than laundry pretreatment. In general, the device contains a functional formulation and delivers the formulation to a surface. After the formulation is delivered, the treated surface is contacted by the absorbent pad to distribute the formulation on, or absorb excess formulation from, the treated surface.

In a preferred embodiment, the functional formulation is selected from the group consisting of upholstery cleaners, glass cleaners, electronic device cleaners, bathroom fixture cleaners, furniture care products, floor care products, insect control agents, and fragrances. Other functional formulations suitable for use in association with the disclosed device may be apparent to those of ordinary skill in the art and should be considered within the scope of this disclosure.

According to one embodiment, the disclosed device is used as an applicator for insect repellant and an insect bite relief product on a user's skin. It may also deliver insect poison to desired surfaces in a household. In use, an insect control agent is delivered from a reservoir of the device through the nib to a desired surface. The agent-treated surface is subsequently engaged with one of the absorbent pads for distributing the agent on, and/or absorbing any excess agent from, the treated surface.

In another embodiment, the disclosed device is used as an applicator for an upholstery cleaner, which can be applied to upholsteries such as auto upholstery and carpet to remove small stains thereon. In use, the upholstery cleaner is delivered to the stains through the nib, and rubbed into the stained fabric by the absorbent pad.

In yet another embodiment, the disclosed device may be used as an applicator for cleaning glasses and small electronic devices such as iPods and MP3 players. The device delivers a cleaning composition on the glass or electronic devices and removes stains and soils thereon by engaging the glass or electronic devices with the absorbent pad.

According to a further embodiment, the disclosed device may be used as an applicator for a grout cleaner that cleans hard to reach surfaces in a bathroom, such as nooks and crannies of faucets and other bathroom fixtures. In use, the device delivers a grout cleaning formulation to the surfaces, which is subsequently scrubbed by the absorbent pad that preferably includes a stiff scrubbing surface like the pre-treating device discussed above.

In another embodiment, the disclosed device may be used as an applicator for a furniture care product, such as a wood scratch cover product, wherein the product is contained in the device and delivered to a wood scratch through the nib. The product is then smeared over the scratch with the absorbent pad to make the scratch less visible. Alternatively, the furniture care product can be a crevice cleaning product, in which case the device functions similarly as the grout cleaning device discussed above.

In yet another embodiment, the disclosed device may be used as an applicator for a floor care product to remove heel marks or scuff on a floor. In use, a floor cleaning composition contained in the device is delivered to the heel marks or scuff through the nib, and the heel marks or scuff is removed by scrubbing the surface of the marked or scuffed floor with the absorbent pad, which preferably includes a stiff scrubbing surface.

According to a final embodiment, the disclosed device may be used to deliver a fragrance to a surface, wherein the fragrance is contained in the device and delivered to the surface through the nib. The fragrance is then distributed on the surface by the absorbent pad. The absorbent pad also functions to absorb any spilled or excess fragrance from the surface.

In general, functional formulations purported to clean a surface may comprise water and one or more surfactants. Preferably, the one or more surfactants are selected from the group consisting of anionic surfactants, cationic surfactants, nonionic surfactants, amphoteric surfactants, and mixtures thereof. The formulation may also include an organic solvent including an alcohol such as ethanol and/or a hydrocarbon solvent such as limonene.

The formulation may include one or more active ingredients to further improve the stain treatment performance thereof. Such active ingredients may include, but are not limited to bleaches, oxidants, enzymes, and caustic bases. The formulation preferably includes an acid such as citric acid.

The formulation may further include additional adjuvants including, but not limited to, fragrances, thickeners, anti-formers, preservatives, chelating agents, etc.

The anionic surfactants may be selected from the group consisting of sodium lauryl sulfate, isopropyl amine sulfonate, sodium capryl sulfonate and mixtures thereof. Preferably, the anionic surfactants are provided in the form of a combination of sodium lauryl sulfate, isopropyl amine sulfonate, and sodium capryl sulfonate. Suitable anionic surfactants may further be selected from the group consisting of alkyl sulfates, alkyl ethoxy sulfates (AES) such as NaAES and $NH_4$AES, amine oxides, and mixtures thereof. The alkyl sulfate surfactants may include branched-chain and random $C_{10}$-$C_{20}$ alkyl sulfates, and $C_{10}$-$C_{18}$ secondary (2,3) alkyl sulfates of the formula $CH_3(CH_2)_x(CHOSO_3M^+)CH_3$ and $CH_3\ (CH_2)_y(CHOSO_3M^+)CH_2CH_3$ where x and (y+1) are integers of at least 7, preferably at least 9, and M is a water-solubilizing cation, especially sodium, as well as unsaturated sulfates such as oleyl sulfate. Alkyl ethoxy sulfate (AES) surfactants used herein are conventionally depicted as having the formula $R(EO)_xSO_3Z$, wherein R is $C_{10}$-$C_{16}$ alkyl, $(EO)_x$ is $(CH_2CH_2O)_x$, x is 1-10 and can include mixtures which are conventionally reported as averages, e.g., $(EO)_{2\ 5}$, $(EO)_{6\ 5}$ and the like, and Z is a cation such as sodium ammonium or magnesium (MgAES). The $C_{12}$-$C_{16}$ alkyl dimethyl amine oxide surfactants can also be used.

Nonionic surfactants should have a HLB value in the range of 9-17 and may include but are not limited to: the ethoxylated octylphenols; ethoxylated fatty alcohols, including the ethoxylated primary fatty alcohols; ethoxylated secondary fatty alcohols; ethoxylated nonylphenols; ethoxylated sorbitan fatty acid esters; sorbitan fatty acid esters; linear ethoxylated ethoxylated alcohols; O—X—O alcohol ethoxylates; and mixtures thereof.

Optional chelating agents include but are not limited to: lactic acid; the salts of ethylenediamine tetraacetic acid (EDTA), such as ethylenediamine tetraacetic acid disodium salt, ethylenediamine tetraacetic acid diammonium salt, ethylenediamine tetraacetic acid trisodium salt, ethylenediamine tetraacetic acid tetrasodium salt, ethylenediamine tetraacetic acid tetrapotassium salt, ethylenediamine tetraacetic acid tetrammonium salt and the like; the salts of diethylenetriaminepentaacetic acid (DTPA), such as diethylenetriaminepentaacetic acid pentapotassium salt and the like; the salts of (N-hydroxyethyl)ethylenediaminetriacetic acid (HEDTA), such as (N-hydroxyethyl)ethylenediaminetriacetic acid trisodium salt, (N-hydroxyethyl)ethylene-diaminetriacetic acid tripotassium salt and the like; the salts of nitrilotriacetic acid (NTA), such as nitrilotriacetic acid trisodium salt, nitrilotriacetic acid tripotassium salt and the like; other chelating agents such as triethanolamine, diethanolamine, monoethanolamine and the like, and mixtures thereof. However, because of its low cost and effectiveness, the preferred chelating agent is citric acid.

To maintain the VOC level below the maximum allowed by certain federal and state regulations, if ethanol is used at all, the ethanol content should not exceed 7.5 wt %. D-limonene can also be used with water instead of or in combination with ethanol.

Pre-Spotting Formulation

Pre-spotting formulations are well known in the art. Such formulations are extensively discussed in U.S. Pat. Nos. 3,562,208; 4,530,781; 4,595,527; 4,749,516; 5,612,306; 5,912,220; and 6,066610, all of which are incorporated by reference herein.

As the stained fabric is not treated while being worn, active ingredients that are generally not compatible with human skin, such as oxidants, caustic bases, bleaches, can be included in the pre-spotting formulation to facilitate dissolving, dislodging and/or break-up of the stains. Moreover, higher concentrations of surfactants, which are not suitable for the stain removal formulations discussed because of their tendency to leave residues, can also be include in the pre-spotting formulation as the fabric is preferably laundered shortly after the treatment.

Thus, a person of ordinary skill in the art should be able to select suitable pre-treating formulations for use in the pre-spotting cleaning device according to this disclosure and general knowledge in the technical field. Three exemplary pre-spotting formulations are listed below:

Example 1

| Ingredients | Weight Percent |
|---|---|
| Water | 79.212 wt % |
| Linear alcohol ethoxylate | 11.800 wt % |
| Citric acid | 5.18 wt % |
| NaOH | 3.17 wt % |
| Protease enzyme | 0.40 wt % |
| Silicone antifoamer | 0.001 wt % |
| Preservative | 0.037 wt % |
| Fragrance | 0.100 wt % |
| Polymeric thickener | 0.100 wt % |

Example 2

| Function/Description | Ingredients | Weight Percent |
|---|---|---|
| Nonionic soil release polymer | Sokalan HP-22 | 1.00 wt % |
| Nonionic surfactant | Neodol 23-4.1 | 2.00 wt % |
| Nonionic surfactant | Neodol 25-7 | 7.00 wt % |
| Amphoteric surfactant | Deriphat 151-C | 6.00 wt % |
| Tetradecene | Neodene 14 | 1.00 wt % |
| Acid | 50% citric acid | 0.56 wt % |
| Fragrance | Fragrance | 0.10 wt % |
| Hydrolyzing protease | Genencor AFP 1000A | 1.00 wt % |
| Preservative | Kathon CG-ICP | 0.3 wt % |
| Solvent | Water | balance |

Example 3

| Function/Description | Ingredients | Weight Percent |
|---|---|---|
| Solvent | Water | 60.90 wt % |
| Acid | Citric acid | 5.00 wt % |
| Base | NaOH | 3.10 wt % |
| Anionic surfactant | Aerosol OT-S | 6.00 wt % |
| Anionic surfactant | Gafac RM410 | 2.00 wt % |
| Nonionic surfactant | Span 80 | 0.60 wt % |
| Nonionic surfactant | Tween 80 | 1.40 wt % |
| Hydrocarbon solvent | Isopar K | 20.00 wt % |
| Hydrocarbon solvent | Limonene | 1.00 wt % |

It is noteworthy that all three exemplary formulations contain caustic base (NaOH) and high concentrations of surfactants, both of which are incompatible with the stain treatment formulation used in the "on-the-go" stain removal device.

Alternative Functional Formulation-Upholstery Cleaner

An exemplary formulation for cleaning upholstery, such as auto upholstery and carpet, is listed below:

Example 4

| Raw Material Name | % Wt |
|---|---|
| Deionized water | 96.570100 |
| Isopropylamine sulfonate, liquid | 0.163100 |
| Symrise O/7W1035 | 0.150000 |
| $C_{12-15}$ ethoxylated alcohols, 9 moles | 0.122400 |
| Hydrogen peroxide, 35%, cosmetic grade | 2.860000 |
| Sodium capryl sulfonate 38% | 0.109400 |
| Citric acid, 50% aqueous | 0.025000 |

In use, the upholstery-cleaning formulation is delivered to small stains on the upholstery through the nib, and distributed or rubbed onto the stained upholstery with the absorbent pad. The absorbent pad also functions to wick off any excess cleaning formulation thereby reducing the drying time of the resulting wet spot.

Alternative Functional Formulation-Glass and Electronic Device Cleaner

An exemplary cleaning formulation for cleaning glass and/or small electronic devices such as iPods and MP3 players is listed below:

Example 5

| Raw Material Name | % Wt |
|---|---|
| Soft water | 94.792600 |
| Isopropanol, anhydrous | 3.000000 |
| Ethylene glycol n-hexyl ether | 0.600000 |
| Ammonium hydroxide | 0.300000 |
| Propylene glycol | 0.250000 |
| Monoethabolamine | 0.450000 |
| MACKAM 2CSF | 0.450000 |
| Liquitint Sky Blue | 0.007400 |
| I.F.F. 2302 HS MOD 6 | 0.050000 |
| Polyquat Ampho 149 | 0.100000 |

In use, the cleaning formulation is delivered on the glass or electronic devices through the nib and stains and soils on the glass or electronic devices are removed by the absorbent pad. The absorbent pad also functions to wick off any excess cleaning formulation thereby reducing the drying time of the glass or electronic device.

Alternative Functional Formulation-Grout Cleaner

An exemplary cleaning formulation for cleaning nooks and crannies of bathroom fixtures is listed below:

Example 6

| Raw Material Name | % By Wt |
|---|---|
| Soda ash (sodium carbonate) | 3.460000 |
| Caustic soda, 50% aqueous | 1.100000 |
| Sodium hypochlorite, 15% | 21.330000 |
| AMMONYX DO C10 amine oxide | 3.330000 |
| Quest Q-14452-1 | 0.100000 |
| Deionized water | 70.680000 |

In use, the grout cleaning formulation is delivered to the nooks and crannies, which is subsequently scrubbed by the absorbent pad that preferably includes a stiff scrubbing surface. The absorbent pad also functions to wick off any excess cleaning formulation after the cleaning is finished.

Formulations not intended to clean surfaces may comprise active ingredients that are suitable for their intended applications. It is to be understood that the functional formulation suitable for various applications would be apparent to one of ordinary skill in the art and therefore should be considered as limiting the scope of this disclosure. An exemplary functional formulation not purported to clean a surface is listed below.

Alternative Functional Formulation-Wood Scratch Coverer

An exemplary formulation for covering scratches on woodwork is listed below:

Example 7

| Raw Material Name | % By Wt |
|---|---|
| Ethylene glycol | 0.030400 |
| Diethylaminoethanol | 0.190000 |
| Caustic potash, flake 90% | 0.015200 |
| Polyoxyethylene (20) sorbitan monolaureate | 0.090000 |
| Sulfonated aliphatic polyester, 48% | 0.050000 |
| Oleic acid | 0.026800 |
| Treibutoxyethyl phosphate | 0.300000 |
| Zinc oxide | 0.037118 |
| Dow Corning Q2-5211 Super Wetting Agent | 0.070000 |
| Tap water | 85.380882 |
| Refined paraffin 132\134 MP | 0.190000 |
| BIOBAN CS 1135 | 0.019000 |
| PROXEL GXL | 0.020000 |
| Isotridecanol polyglycol ether | 0.095000 |
| AC 680 polyethylene wax | 2.090000 |
| GENAPOL X-060 | 0.266000 |
| Resin SR 650 - Diransa | 2.318200 |
| I.F.F. Halloween MOD CE | 0.261000 |
| Ammonia 25% | 0.750400 |
| Polymer C-67 US INT 225367 | 7.700000 |
| CI Pigment Red 112 CI 12370 | 0.100000 |

In use, the formulation contained in the device is delivered to a wood scratch through the nib. The product is then smeared over the scratch with the absorbent pad to make the scratch less visible. The absorbent pad also functions to wick off any excess formulation after the wood scratch is properly covered.

While only certain embodiments have been set forth, alternatives and modifications will be apparent from the above description to those skilled in the art. These and other alternatives are considered equivalents and within the spirit and scope of this disclosure and the appended claims.

What is claimed:

1. An applicator for applying a pre-treating formulation to fabric, comprising: a fluid reservoir in communication with a valve assembly, the fluid reservoir containing a pre-treating formulation; and a shell connected to the fluid reservoir for accommodating an absorbent material, the shell comprising an opening through which the absorbent material can extend, the absorbent material comprising a scrubbing surface disposed outside of the shell, and the valve assembly comprising an exit orifice, wherein the absorbent material comprises a ring with a plurality of outwardly extending pads, and wherein the ring may be rotated within the shell to expose at least one pad through the opening at a time.

2. The applicator of claim 1 wherein the device further comprises an actuator connected to the ring for actuating the rotation of the ring within the shell.

3. The applicator of claim 2 wherein the actuator is a dial.

4. The applicator of claim 1 wherein the absorbent pads comprise mailed fibers.

5. The applicator of claim 1 wherein the absorbent pads comprise polyester felt.

6. The applicator of claim 1 wherein the valve assembly further comprises a restrictive flow element providing communication between the reservoir and a throttle element.

7. The applicator of claim 6 wherein relative movement between the restrictive flow element and throttle element establishes or prevents communication between the reservoir and the exit orifice.

8. The applicator of claim 6 wherein rotation of the throttle element with respect to the restrictive flow element establishes or prevents communication between the reservoir and the exit orifice.

9. The applicator of claim 6 wherein axial movement of the throttle element with respect to the restrictive flow element establishes or prevents communication between the reservoir and the exit orifice.

10. The applicator of claim 6 wherein the reservoir is disposed between the shell and the restrictive flow element and the restrictive flow element is disposed between the reservoir and the throttle element.

11. The applicator of claim 1 wherein the pre-treating formulation comprises an active ingredient selected from the group consisting of oxidants, bleaches, and caustic bases.

12. A device for applying a functional formulation to a surface, comprising: a reservoir containing a functional formulation and disposed between and connected to both a valve assembly and a shell, the shell accommodating an absorbent material and an opening through which the absorbent material can extend, wherein the absorbent material optionally comprises a scrubbing surface disposed outside of the shell, the valve assembly comprising a restrictive flow element providing communication between the reservoir and a throttle element, the throttle element comprising an exit orifice, wherein relative movement between the restrictive flow element and throttle element establishes or prevents communication between the reservoir and the exit orifice.

13. The device of claim 12 wherein rotation of the throttle element with respect to the restrictive flow element establishes or prevents communication between the reservoir and the exit orifice.

14. The device of claim 12 wherein axial movement of the throttle element with respect to the restrictive flow element establishes or prevents communication between the reservoir and the exit orifice.

15. The device of claim 12 wherein the absorbent material comprises a ring with a plurality of pads extending outwardly, wherein the ring may be rotated within the shell to expose at least one pad through the opening at a time.

16. The device of claim 12 wherein the functional formulation is selected from the group consisting of insect control agents, upholstery cleaners, glass cleaners, electronic device cleaners, bathroom fixture cleaners, wood cleaners, wood scratch coverers, floor cleaners, and fragrances.

17. A method for applying a functional formulation on a surface, the method comprising: providing an applicator, the applicator comprising a reservoir containing the functional formulation, a valve assembly connected to the reservoir and a shell comprising an opening, the shell accommodating a ring of absorbent pads connected to an actuator for rotating the ring of pads to move one of the pads into alignment with and extending through the opening of the shell; delivering the functional formulation to the surface through the valve assembly; rotating the device and engaging the surface and the delivered formulation with one of the pads that is in alignment with and extending through the opening in the shell; and wicking at least some of the formulation from the surface by the pad.

18. The method according to claim 17 wherein the pad comprises a scrubbing surface.

19. The method according to claim 17 wherein the functional formulation is selected from the group consisting of insect control agents, upholstery cleaners, glass cleaners, electronic device cleaners, bathroom fixture cleaners, wood cleaners, wood scratch coverers, floor cleaners, and fragrances.

* * * * *

UNITED STATES PATENT AND TRADEMARK OFFICE

CERTIFICATE OF CORRECTION

PATENT NO. : 7,743,443 B2
APPLICATION NO. : 11/767251
DATED : June 29, 2010
INVENTOR(S) : Roberta A. Wick et al.

It is certified that error appears in the above-identified patent and that said Letters Patent is hereby corrected as shown below:

Column 16, Line 6: replace "mailed" with --matted--

Signed and Sealed this

Ninth Day of November, 2010

David J. Kappos

David J. Kappos
*Director of the United States Patent and Trademark Office*